US009823606B2

(12) United States Patent
Otsuka et al.

(10) Patent No.: US 9,823,606 B2
(45) Date of Patent: Nov. 21, 2017

(54) IMAGE FORMING APPARATUS, CONTROL METHOD, AND NON-TRANSITORY STORAGE MEDIUM

(71) Applicant: Konica Minolta, Inc., Chiyoda-ku, Tokyo (JP)

(72) Inventors: Yutaka Otsuka, Toyokawa (JP); Masashi Saito, Hachioji (JP); Ryohei Matsuo, Toyokawa (JP); Toshihito Kobayashi, Akashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/213,612

(22) Filed: Jul. 19, 2016

(65) Prior Publication Data

US 2017/0023896 A1 Jan. 26, 2017

(30) Foreign Application Priority Data

Jul. 21, 2015 (JP) ..... 2015-143957

(51) Int. Cl.
*G03G 15/20* (2006.01)
*G03G 21/20* (2006.01)
*G03G 15/00* (2006.01)

(52) U.S. Cl.
CPC ..... *G03G 15/2039* (2013.01); *G03G 21/206* (2013.01); *G03G 15/2003* (2013.01);
(Continued)

(58) Field of Classification Search
CPC ..... G03G 15/2078
(Continued)

(56) References Cited

U.S. PATENT DOCUMENTS 8,675,229 B2 3/2014 Kawamata et al.
2012/0294640 A1* 11/2012 Arakawa ..... G03G 15/205 399/69

FOREIGN PATENT DOCUMENTS

JP H02-311861 A 12/1990
JP 2004-230605 A 8/2004
(Continued)

OTHER PUBLICATIONS

Office Action (Notice of Grounds of Rejection) dated Apr. 18, 2017, by the Japanese Patent Office in corresponding Japanese Patent Application No. 2015-143957, with an English translation of the Office Action. (9 pages).

*Primary Examiner* — Clayton E Laballe
*Assistant Examiner* — Kevin Butler
(74) *Attorney, Agent, or Firm* — Buchanan Ingersoll & Rooney PC

(57) ABSTRACT

An image forming apparatus has an operating state and a non-operating state with power consumption smaller than in the operating state. The image forming apparatus includes a fixing device for fixing a toner image on a print material by heat, a fan for discharging heat from the image forming apparatus, and a control unit for controlling operation of the fan. When a non-operating time from shifting to the non-operating state to shifting to the operating state is shorter than a predetermined time, the control unit allows the fan to operate with predetermined power in the operating state. When the non-operating time is equal to or longer than the predetermined time, the control unit stops the fan or allows the fan to operate with power smaller than the predetermined power in the operating state.

30 Claims, 11 Drawing Sheets

(52) U.S. Cl.
CPC ..... *G03G 15/2064* (2013.01); *G03G 15/2078* (2013.01); *G03G 15/5004* (2013.01); *G03G 2215/0132* (2013.01); *G03G 2215/2016* (2013.01)

(58) Field of Classification Search
USPC ..... 399/70
See application file for complete search history.

(56) References Cited

FOREIGN PATENT DOCUMENTS

| | | | | | |
|---|---|---|---|---|---|
| JP | 2008-145599 | A | | 6/2008 | |
| JP | 2008145599 | | * | 6/2008 | ..... G03G 21/20 |
| JP | 2011-067973 | A | | 4/2011 | |
| JP | 2012-081709 | A | | 4/2012 | |
| JP | 2012-242635 | A | | 12/2012 | |
| JP | 2015-099268 | A | | 5/2015 | |

* cited by examiner

IMAGE FORMING APPARATUS, CONTROL METHOD, AND NON-TRANSITORY STORAGE MEDIUM

This application is based on Japanese Patent Application No. 2015-143957 filed with the Japan Patent Office on Jul. 21, 2015, the entire content of which is hereby incorporated by reference.

BACKGROUND OF THE INVENTION

Field of the Invention

The present disclosure relates to control of an image forming apparatus, and more particularly to control of the fan included in an image forming apparatus.

Description of the Related Art

Electrophotographic image forming apparatuses are commonly used. An electrophotographic image forming apparatus includes a fixing device. The fixing device fuses a toner image by heat to fix the toner image on a print material. In connection with a technique for adjusting the temperature for fixing a toner image on a print material, Japanese Laid-Open Patent Publication No. 2012-242635 discloses an image forming apparatus in which "the surface temperature of the heating member can be maintained in STANDBY mode within a range of setting temperatures without causing temperature overshoot or undershoot".

The temperature inside an image forming apparatus may be increased by heat generated from the fixing device. This may cause a failure in a device inside the image forming apparatus. The heat generated from the fixing device therefore should be discharged from the image forming apparatus. An example of the device that discharges heat inside an image forming apparatus is a fan. The fan reduces the temperature inside the image forming apparatus or the fixing device by blowing air to heat in the conveyance path of a print material from the fixing device or the power supply board. In connection with control of the fan, Japanese Laid-Open Patent Publication No. 2008-145599 discloses an image forming apparatus in which "the fan motor is allowed to operate only when necessary".

When the fan is allowed to operate unnecessarily, electricity is wasted and/or noise is generated. It is therefore preferable to minimize the operation of the fan.

The image forming apparatus disclosed in Japanese Laid-Open Patent Publication No. 2008-145599 reduces the operation time of the fan motor after a print operation is finished, if the number of printed sheets is small. This is because if the number of printed sheets is small, the temperature inside the apparatus is not increased much. Unfortunately, the image forming apparatus always allows the fan to operate after a print operation is finished, and allows unnecessary operation of the fan.

SUMMARY OF THE INVENTION

An object of the present disclosure according to an aspect is to provide an image forming apparatus capable of suppressing unnecessary operation of the fan. An object according to another aspect is to provide a control method capable of suppressing unnecessary operation of the fan. An object according to a further aspect is to provide a control program capable of suppressing unnecessary operation of the fan.

According to an aspect, an image forming apparatus is provided, which has an operating state and a non-operating state with power consumption smaller than power consumption in the operating state. The image forming apparatus includes a fixing device for fixing a toner image on a print material by heat, a fan for suppressing increase of temperature inside the image forming apparatus by the heat, and a control unit for controlling operation of the fan. The control unit allows the fan to operate with first predetermined power in the operating state when a time from shifting to the non-operating state to shifting to the operating state is shorter than a first predetermined time. The control unit allows the fan to stop or allows the fan to operate with second predetermined power smaller than the first predetermined power in the operating state when the time is equal to or longer than the first predetermined time.

Preferably, the control unit deactivates suppression control of the fan by the control unit when the time is equal to or longer than a second predetermined time longer than the first predetermined time.

Preferably, the control unit executes suppression control of the fan by the control unit when the time is equal to or longer than the first predetermined time and the time is shorter than the second predetermined time.

Preferably, the image forming apparatus further includes a counter for counting a number of repetitions of the operating state and the non-operating state. The control unit deactivates suppression control of the fan by the control unit when the number of repetitions reaches a predetermined number or greater.

Preferably, the counter clears the number of repetitions, based on power-on of the image forming apparatus.

Preferably, the control unit deactivates suppression control of the fan by the control unit when a suppression time of the fan by the control unit reaches a predetermined time.

Preferably, the fixing device includes a sensor for detecting temperature of the fixing device. The image forming apparatus executes a warm-up function for increasing temperature of the fixing device to a temperature that allows the toner image to be fixed on the print material, based on acceptance of a print instruction. The control unit executes suppression control of the fan by the control unit when second printing since power-on of the image forming apparatus is executed to cause a shift from the non-operating state to the operating state and the temperature at start of the warm-up function is equal to or lower than a predetermined temperature.

Preferably, the control unit deactivates suppression control of the fan by the control unit when first printing since power-on of the image forming apparatus causes a shift to the operating state and a second print instruction is accepted before shifting from the operating state to the non-operating state.

Preferably, the control unit deactivates suppression control of the fan by the control unit when equipment registered beforehand is connected to the image forming apparatus.

Preferably, the control unit deactivates suppression control of the fan by the control unit when a function registered beforehand is executed.

According to another aspect, a control method for an image forming apparatus is provided. The image forming apparatus has an operating state and a non-operating state with power consumption smaller than power consumption in the operating state. The image forming apparatus includes a fixing device for fixing a toner image on a print material by heat, and a fan for suppressing increase of temperature inside the image forming apparatus by the heat. The control method includes: allowing the fan to operate with first predetermined power in the operating state when a time from shifting to the non-operating state to shifting to the operating state is shorter than a first predetermined time; and allowing the fan to stop or allowing the fan to operate with second predetermined power smaller than the first predetermined power in the operating state when the time is equal to or longer than the first predetermined time.

According to a further aspect, a non-transitory storage medium encoded with a program for an image forming apparatus is provided. The image forming apparatus has an operating state and a non-operating state with power consumption smaller than power consumption in the operating state. The image forming apparatus includes a fixing device for fixing a toner image on a print material by heat, and a fan for suppressing increase of temperature inside the image forming apparatus by the heat. The control program allows the image forming apparatus to execute: allowing the fan to operate with first predetermined power in the operating state when a time from shifting to the non-operating state to shifting to the operating state is shorter than a first predetermined time; and allowing the fan to stop or allowing the fan to operate with second predetermined power smaller than the first predetermined power in the operating state when the time is equal to or longer than the first predetermined time.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described below with reference to the drawings. In the following description, the same parts and components are denoted with the same reference signs. Their names and functions are also the same, and a detailed description thereof will not be repeated. Embodiments and modifications described below may be selectively combined as appropriate.

[Image Forming Apparatus 100]

Figure 1:
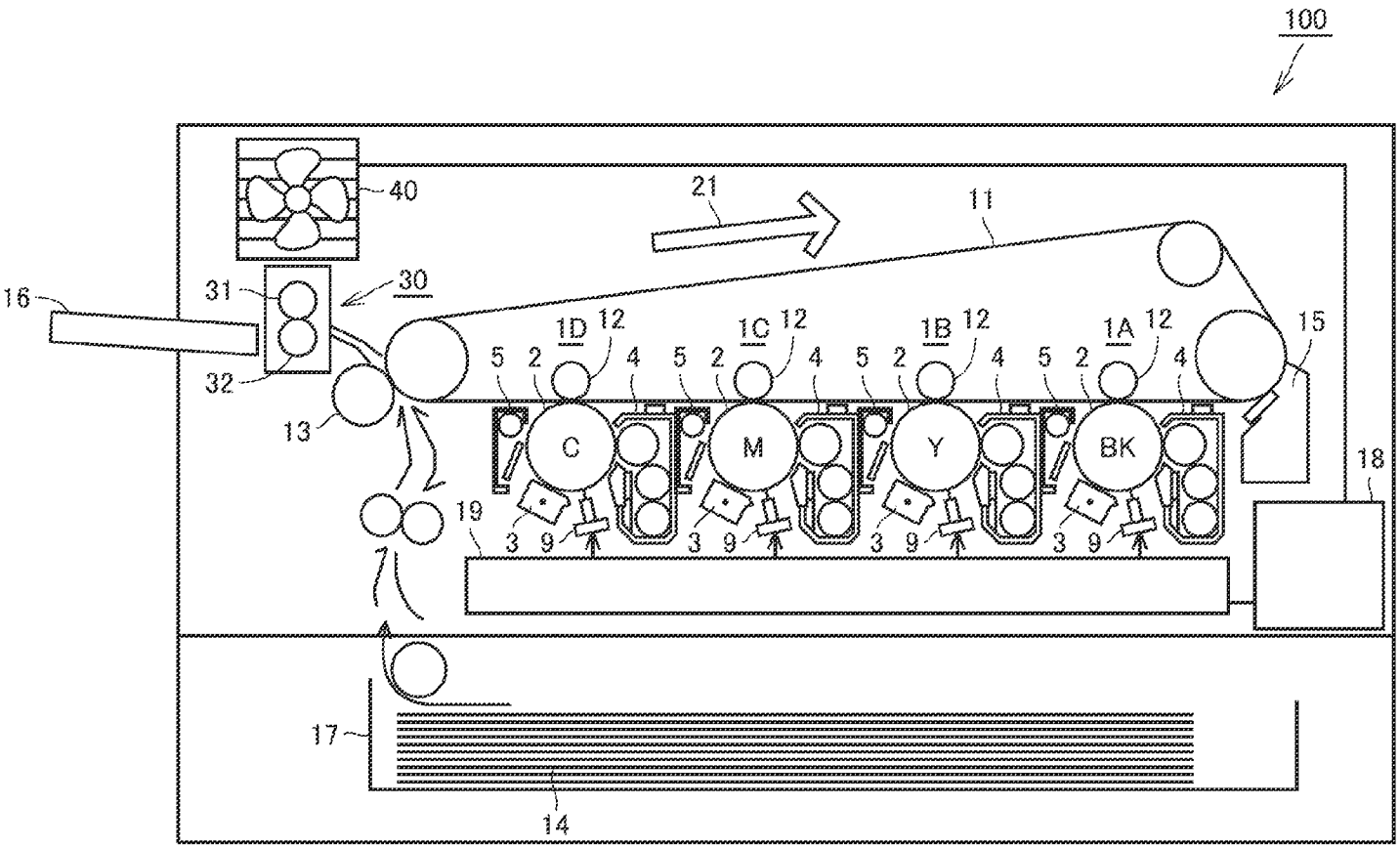
FIG. 1 is a diagram showing an exemplary apparatus configuration of an image forming apparatus according to an embodiment.

Referring to FIG. 1, an image forming apparatus 100 according to an embodiment will be described. FIG. 1 is a diagram showing an exemplary apparatus configuration of image forming apparatus 100.

FIG. 1 shows image forming apparatus 100 as a color printer. Although image forming apparatus 100 as a color printer will be described below, image forming apparatus 100 is not limited to a color printer. For example, image forming apparatus 100 may be a monochrome printer or a multi-functional peripheral (MFP) which is a combination of a monochrome printer or a color printer and a facsimile.

Image forming apparatus 100 includes image forming units 1A to 1D, an intermediate transfer belt 11, primary transfer units 12, a secondary transfer unit 13, a cleaning unit 15, a paper output tray 16, a cassette 17, a control device 18, an exposure control unit 19, a fixing device 30, and a fan 40.

Image forming unit 1A forms a black (BK) toner image. Image forming unit 1B forms a yellow (Y) toner image. Image forming unit 1C forms a magenta (M) toner image. Image forming unit 1D forms a cyan (C) toner image. Intermediate transfer belt 11 rotates in the direction of arrow 21. Image forming units 1A to 1D are arranged in order along the direction in which intermediate transfer belt 11 rotates.

Image forming units 1A to 1D each include a photoconductor 2, a charging unit 3, a development unit 4, a cleaning unit 5, and an exposure unit 9.

Photoconductor 2 is an image carrier that carries a toner image thereon. Photoconductor 2 is, for example, a photoconductor drum having a photosensitive layer on its surface. Photoconductor 2 rotates in the direction corresponding to the direction in which intermediate transfer belt 11 rotates.

Charging unit 3 uniformly charges the surface of photoconductor 2. Exposure unit 9 emits laser to photoconductor 2 in response to a control signal from exposure control unit 19 and exposes the surface of photoconductor 2 in accordance with the specified image pattern. An electrostatic latent image corresponding to an input image is thus formed on photoconductor 2.

Development unit 4 develops the electrostatic latent image formed on photoconductor 2 as a toner image. As an example, development unit 4 develops the electrostatic latent image using a two-component developer including toner and carrier.

The toner image formed on the surface of the photoconductor 2 is transferred onto intermediate transfer belt 11 by primary transfer unit 12. A black (BK) toner image, a yellow (Y) toner image, a magenta (M) toner image, and a cyan (C) toner image are successively superimposed to be transferred onto intermediate transfer belt 11. A color toner image is thus formed on intermediate transfer belt 11.

Cleaning unit 5 includes a cleaning blade. The cleaning blade is pressed against photoconductor 2 to recover toner left on photoconductor 2 after the toner image is transferred.

Primary transfer unit 12 transfers the toner image developed on the photoconductor 2 onto the intermediate transfer belt 11. Photoconductor 2 and intermediate transfer belt 11 are in contact with other at the position where primary transfer unit 12 is provided. A predetermined transfer bias is applied to this contact section, and this transfer bias causes the toner image on photoconductor 2 to be transferred onto intermediate transfer belt 11.

Cassette 17 is provided at the bottom of image forming apparatus 100. A print material 14 such as paper is set in cassette 17. Print material 14 is sent one by one from cassette 17 to secondary transfer unit 13. The timing of feeding and conveying print material 14 is synchronized with the position of the toner image on intermediate transfer belt 11, so that the toner image is transferred to the appropriate position on print material 14. Print material 14 is then sent to fixing device 30.

Fixing device 30 fuses the toner image transferred on print material 14 by heat and fixes the toner image on print material 14. Print material 14 is then discharged to paper output tray 16. The details of fixing device 30 will be described later.

Cleaning unit 15 includes a cleaning blade. The cleaning blade is pressed against intermediate transfer belt 11 and collects toner left on intermediate transfer belt 11 after the toner image is transferred. The toner is conveyed by a conveyance screw (not shown) to be collected in a waster toner container (not shown).

Control device 18 controls image forming apparatus 100. Control device 18 controls, for example, exposure control unit 19 and fan 40. Control device 18 controls fan 40 to adjust the rotation amount and the rotation time of fan 40. That is, fan 40 discharges heat from the inside of image forming apparatus 100 in accordance with a control signal from control device 18. This prevents the conveyance path of a print material from fixing device 30, control device 18 serving as a controller board, a power supply board, and devices in image forming apparatus 100, such as primary transfer unit 12, secondary transfer unit 13, and exposure control unit 19 from reaching a certain temperature or higher. The motor (not shown) of fan 40 is controlled by, for example, PWM (Pulse Width Modulation).

[Fan Control]

Figure 2A:
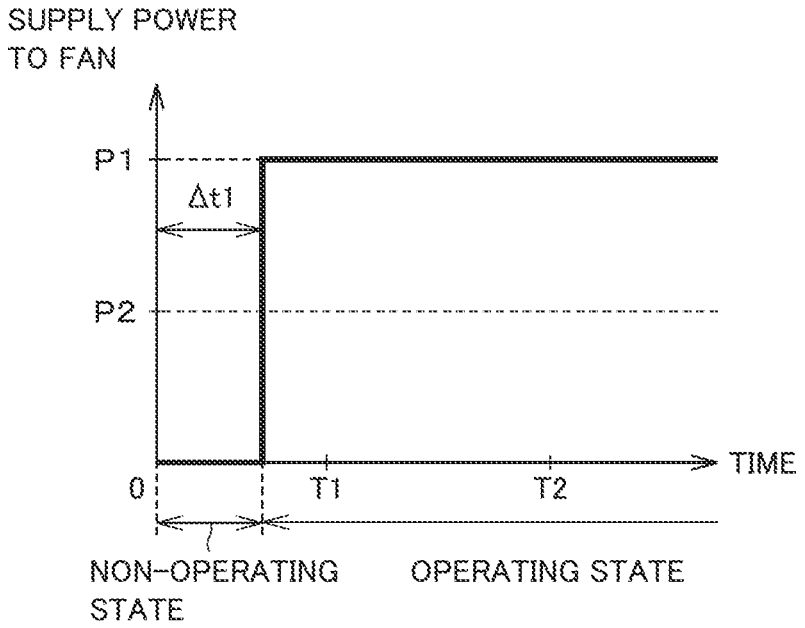
FIG. 2A and FIG. 2B are diagrams showing the relation between the states of the image forming apparatus according to an embodiment and supply power to the fan
Figure 2B:
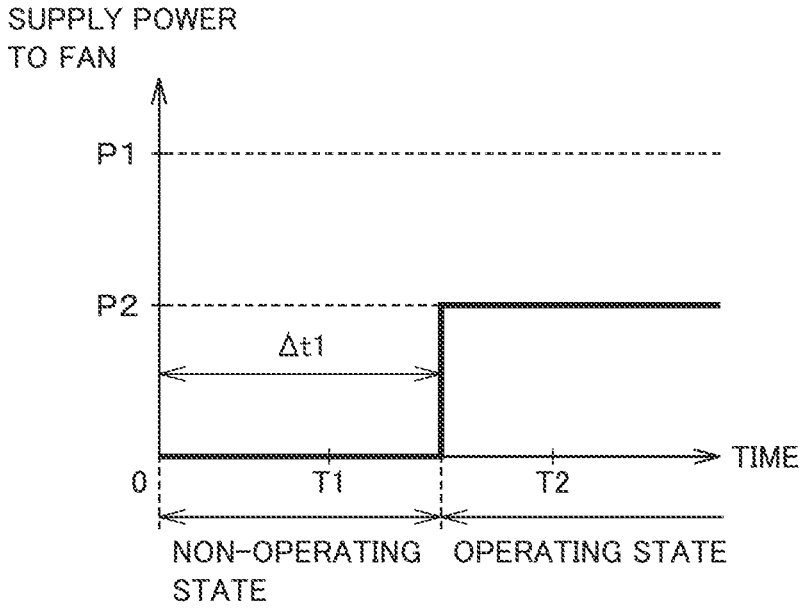

Referring to FIG. 2A and FIG. 2B, control of fan 40 (see FIG. 1) by image forming apparatus 100 will be described. FIG. 2A and FIG. 2B are diagrams showing the relation between the states of image forming apparatus 100 and supply power to fan 40.

Image forming apparatus 100 has states including an operating state and a non-operating state. The "operating state" refers to a state in which image forming apparatus 100 is in operation, for example, in response to a print instruction. The "non-operating state" refers to a state in which image forming apparatus 100 is in operation with power consumption smaller than in the operating state. The non-operating state includes, for example, a sleep state in which image forming apparatus 100 is kept in a low-power state, and a state in which a start-up operation to make ready for printing is required.

Control device 18 (see FIG. 1) controls fan 40 in accordance with a state of image forming apparatus 100. More specifically, when image forming apparatus 100 is in the non-operating state, control device 18 does not allow fan 40 to operate. When image forming apparatus 100 shifts from the non-operating state to the operating state, control device 18 controls fan 40 in accordance with the time (hereinafter also referred to as "non-operating time") during which the non-operating state continues before shifting to the operating state.

When the non-operating state continues for a certain time or longer, the internal temperature of image forming apparatus 100 is relatively low. Therefore, even when the operating state continues for some duration, the internal temperature does not become so high. Accordingly, when the operating state and the non-operating state are repeated with intervals, the internal temperature of image forming apparatus 100 naturally decreases without operation of fan 40. Therefore, preferably, control device 18 does not allow fan 40 to operate when the non-operating state continues for a certain time or longer. Alternatively, preferably, control device 18 allows fan 40 to operate with lower power.

In this regard, as shown in FIG. 2A, when non-operating time $\Delta t1$ is shorter than a predetermined time T1 (a first predetermined time), control device 18 allows fan 40 to operate with power P1 (first predetermined power). As shown in FIG. 2B, when non-operating time $\Delta t1$ is predetermined time T1 or longer, control device 18 allows fan 40 to operate with power P2 (second predetermined power) smaller than power P1. Alternatively, control device 18 supplies no power to fan 40 to stop fan 40.

Control device 18 thus can suppress unnecessary operation of fan 40. As a result, while the internal temperature of image forming apparatus 100 is suppressed to a certain temperature or lower, noise of fan 40 can be reduced, power consumption of fan 40 can be suppressed, and the service life of fan 40 can be prolonged.

Suppressing the operation of fan 40 is particularly effective in a situation in which print instructions and the like do not frequently occur. This is because in such a situation, the internal temperature of image forming apparatus 100 does not increase to a certain level or higher without operation of fan 40. Examples of such a situation include the condition of use early in the morning. In a typical condition of use early in the morning, a user turns on the main power to do some prints. Early in the morning, image forming apparatus 100 is used by fewer users and therefore image forming apparatus 100 enters a sleep state for a long time (for example, one hour) after printing. The number of users thereafter gradually increases, and image forming apparatus 100 repeats, for example, printing for 30 seconds or so and a sleep state for 15 minutes or so. In such a condition of use early in the morning, suppressing the operation of fan 40 is effective.

Although control device 18 controls fan 40 with power in two levels in FIG. 2A and FIG. 2B, control device 18 may control fan 40 with power in three or more levels. For example, when non-operating time $\Delta t1$ is predetermined time T1 or longer, control device 18 increases supply power to fan 40 stepwise from power P1 to power P2. Control device 18 thus can suppress unnecessary operation of fan 40.

Although power P2 is constant in the description of FIG. 2A and FIG. 2B, power P2 may not be constant. For example, considering that the cooling state of the internal temperature of image forming apparatus 100 is correlated with non-operating time $\Delta t1$, control device 18 may determine power P2 in accordance with the length of non-operating time $\Delta t1$. More specifically, control device 18 reduces power P2 as non-operating time $\Delta t1$ is longer, and increases power P2 as non-operating time $\Delta t1$ is shorter. The output of fan 40 thus can be suppressed in accordance with the internal temperature of image forming apparatus 100.

[Deactivation of Suppression Mode]

The operation mode in which fan 40 (see FIG. 1) operates with power P1 (see FIG. 2A and FIG. 2B) may hereinafter be referred to as "normal mode", for convenience of explanation. The operation mode in which fan 40 operates with power P2 smaller than power P1 (see FIG. 2A and FIG. 2B) may be referred to as "suppression mode". That is, the rotation speed and the rotation time of fan 40 are suppressed in the suppression mode, compared with the normal mode.

When it is determined that the operation of fan 40 in the suppression mode is not preferable, control device 18 deactivates the operation of fan 40 in the suppression mode.

More specifically, control device 18 determines whether a deactivation condition described below is satisfied, and if determining that the deactivation condition is satisfied, allows fan 40 to operate in the normal mode. The deactivation condition for deactivating the suppression mode is described below.

(Deactivation Condition 1)

Figure 3:
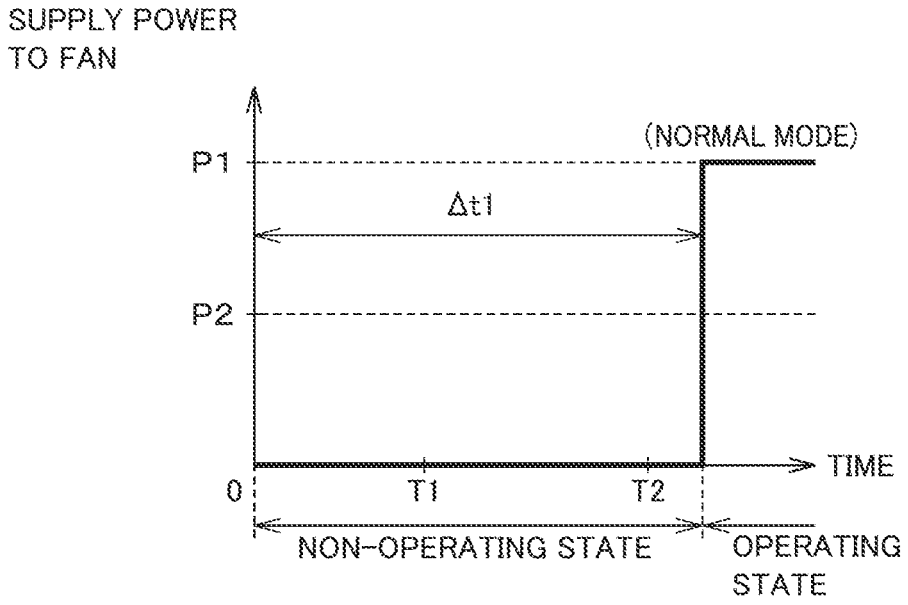
FIG. 3 is a diagram showing the relation between the states of the image forming apparatus and supply power to the fan when a deactivation condition 1 is satisfied.

Referring to FIG. 3, a deactivation condition 1 for deactivating the suppression mode of fan 40 (see FIG. 1) will be described. FIG. 3 is a diagram showing the relation between the state of image forming apparatus 100 and supply power to fan 40 when deactivation condition 1 is satisfied.

When the non-operating state of image forming apparatus 100 continues for a long time, image forming apparatus 100 is cooled off When this state shift to the operating state, control device 18 (see FIG. 1) may rapidly increase the temperature of fixing device 30 in order to make ready for printing. In such a case, preferably, control device 18 allows fan 40 to operate in the normal mode so that the internal temperature of image forming apparatus 100 does not increase.

In this respect, as shown in FIG. 3, when non-operating time Δt1 is equal to or longer than a predetermined time T2 longer than predetermined time T1, control device 18 deactivates the suppression mode of fan 40 and allows fan 40 to operate in the normal mode. Image forming apparatus 100 thus can keep the internal temperature adequately even when the non-operating state of image forming apparatus 100 continues for a long time and the internal temperature of image forming apparatus 100 rapidly increases.

When non-operating time Δt1 is predetermined time T1 or longer and non-operating time Δt1 is shorter than predetermined time T2, control device 18 performs suppression control of fan 40. That is, control device 18 allows fan 40 to operate in the suppression mode. Control device 18 thus can suppress unnecessary operation of fan 40.

Predetermined times T1, T2 may be preset during the manufacturing of image forming apparatus 100 or may be set as desired by the user of image forming apparatus 100.

(Deactivation Condition 2)

Figure 4:
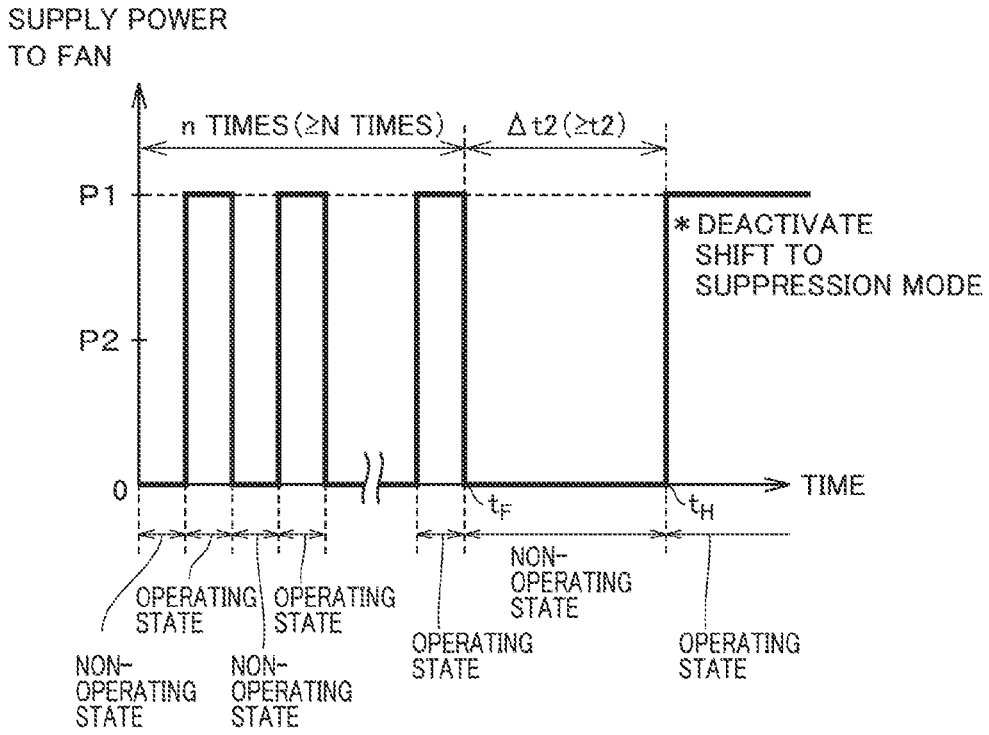
FIG. 4 is a diagram showing the relation between the states of the image forming apparatus and supply power to the fan when a deactivation condition 2 is satisfied.

Referring to FIG. 4, a deactivation condition 2 for deactivating the suppression mode of fan 40 (see FIG. 1) will be described. FIG. 4 is a diagram showing the relation between the states of image forming apparatus 100 and supply power to fan 40 when deactivation condition 2 is satisfied.

When image forming apparatus 100 frequently repeats the operating state and the non-operating state, the internal temperature of image forming apparatus 100 may repeatedly increase and decrease to gradually increase. When the operating state and the non-operating state are frequently repeated, preferably, control device 18 (see FIG. 1) allows fan 40 to operate in the normal mode so that the internal temperature of image forming apparatus 100 does not increase to a certain level or higher.

In this respect, as shown in FIG. 4, when the number of repetitions n of the operating state and the non-operating state of image forming apparatus 100 is a predetermined number N (for example, ten) or greater, control device 18 deactivates the suppression mode of fan 40. That is, after the number of repetitions n reaches predetermined number N or greater, control device 18 allows fan 40 to operate in the normal mode even when the condition for executing the suppression mode is satisfied. Image forming apparatus 100 thus can prevent the internal temperature from increasing to a certain level or higher. Predetermined number N may be preset during the manufacturing of image forming apparatus 100 or may be set as desired by the user of image forming apparatus 100.

The number of repetitions n is counted based on, for example, shifting to at least one of the operating state and the non-operating state. That is, image forming apparatus 100 may count the number of times of shifting to the operating state as the number of repetitions n, or may count the number of times of shifting to the non-operating state as the number of repetitions n, or may count the number of repetitions n based on that the operating state and the non-operating state are repeated.

Preferably, the number of repetitions n is cleared based on power-on of image forming apparatus 100. That is, the number of repetitions n is set to zero every time the power is turned on. The number of repetitions n may be cleared based on that the non-operating state continues for a predetermined time or longer.

(Deactivation Condition 3)

Figure 5:
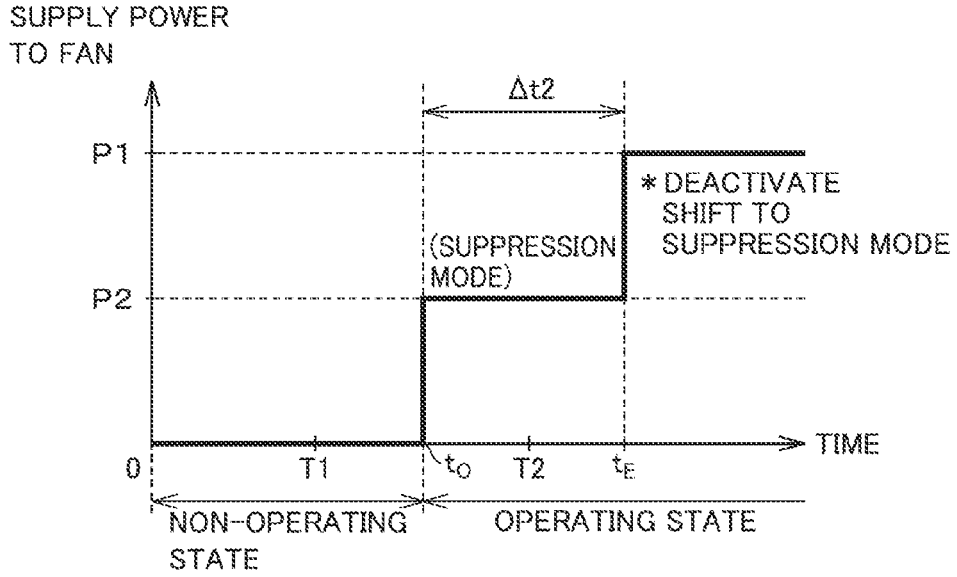
FIG. 5 is a diagram showing the relation between the states of the image forming apparatus and supply power to the fan when a deactivation condition 3 is satisfied.

Referring to FIG. 5, a deactivation condition 3 for deactivating the suppression mode of fan 40 (see FIG. 1) will be described. FIG. 5 is a diagram showing the relation between the states of image forming apparatus 100 and supply power to fan 40 when deactivation condition 3 is satisfied.

As the suppression mode of fan 40 continues, the internal temperature of image forming apparatus 100 increases. When the suppression mode of fan 40 continues for a long time, the internal temperature of image forming apparatus 100 may increase to a certain level or higher.

In order to prevent this, as shown in FIG. 5, when time Δt2 since the start of the suppression mode is a predetermined time (for example, one minute) or longer, control device 18 deactivates the suppression mode of fan 40. That is, control device 18 allows fan 40 to operate in the suppression mode based on that image forming apparatus 100 shifts from the non-operating state to the operating state, and allows fan 40 to operate in the normal mode after the elapse of a predetermined time.

Image forming apparatus 100 thus can suppress unnecessary operation of fan 40 and can prevent the internal temperature from increasing to a certain level or higher.

(Deactivation Condition 4)

A deactivation condition 4 for deactivating the suppression mode of fan 40 (see FIG. 1) will be described.

As described above, allowing fan 40 to operate in the suppression mode is effective in a situation in which print instructions and the like do not frequently occur, for example, early in the morning. However, the operating state of image forming apparatus 100 may exceptionally continue even early in the morning. In this case, the internal temperature of image forming apparatus 100 increases. It is therefore preferable to discharge heat from image forming apparatus 100 so that the internal temperature does not increase to a certain level or higher.

In this respect, control device 18 (see FIG. 1) shifts to the operating state due to the first printing since power-on of image forming apparatus 100, and deactivates the suppression mode of fan 40 when a second print instruction is received before shifting from the operating state to the non-operating state. That is, when the power is turned on early in the morning and print instructions are successively accepted, control device 18 deactivates the suppression mode of fan 40.

Image forming apparatus 100 thus can prevent the internal temperature from increasing to a certain level or higher also when print instructions and the like exceptionally frequently occur.

(Deactivation Condition 5)

A deactivation condition 5 for deactivating the suppression mode of fan 40 (see FIG. 1) will be described.

When equipment with high power consumption is connected to image forming apparatus 100, the processing load on image forming apparatus 100 is high, and the internal temperature of image forming apparatus 100 (for example, the temperature of the power supply board) tends to increase. Equipment that may be connected to image forming apparatus 100 includes, for example, finishers for saddle stitching and others (that is, post-processing devices) and options for bookbinding.

When equipment with high power consumption, such as a finisher and an option, is attached to image forming apparatus 100, control device 18 allows fan 40 to operate in the normal mode. Equipment with high power consumption is registered beforehand in image forming apparatus 100 by the designer or user of image forming apparatus 100. When the equipment registered beforehand is connected to image forming apparatus 100, control device 18 deactivates the suppression mode of fan 40.

Image forming apparatus 100 thus can prevent the internal temperature from increasing to a certain temperature or higher also when equipment with high power consumption is connected to image forming apparatus 100.

(Deactivation Condition 6)

A deactivation condition 6 for deactivating the suppression mode of fan 40 (see FIG. 1) will be described.

When a function involving high processing load, such as color printing, is executed, the amount of radiant heat from the internal devices of image forming apparatus 100 is increased. In order to prevent the internal temperature of image forming apparatus 100 from increasing due to the radiant heat, control device 18 deactivates the suppression mode of fan 40 when a function registered beforehand is executed.

Image forming apparatus 100 thus can prevent the internal temperature from increasing to a certain level or higher also when a function involving high processing load is executed. Such a function is registered beforehand by the designer or user of image forming apparatus 100.

(Deactivation Condition 7)

A deactivation condition 7 for deactivating the suppression mode of fan 40 (see FIG. 1) will be described.

When printing is not done since power-on, for example, early in the morning, image forming apparatus 100 is kept cooled off When this state shifts to the operating state, control device 18 (see FIG. 1) may rapidly increase the temperature of fixing device 30 in order to make it ready for printing. In this case, preferably, control device 18 allows fan 40 to operate in the normal mode so that the internal temperature of image forming apparatus 100 does not increase.

In this respect, when the state shifts to the non-operating state without execution of single printing since power-on, the suppression mode of fan 40 is deactivated. Image forming apparatus 100 thus can keep the internal temperature adequate even when the internal temperature of image forming apparatus 100 rapidly increases.

[Functional Configuration of Image Forming Apparatus 100]

Figure 6:
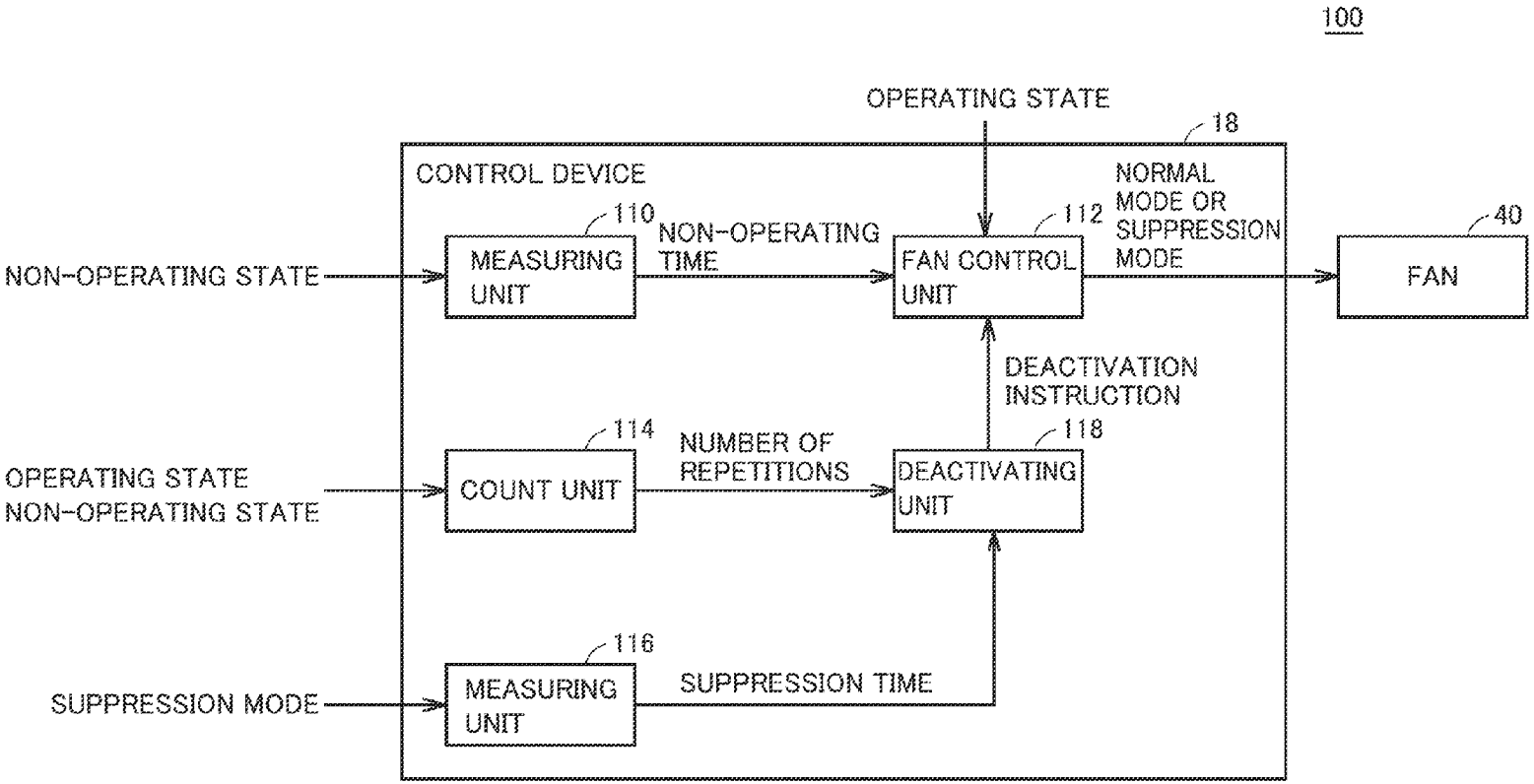
FIG. 6 is a block diagram showing an exemplary functional configuration of the image forming apparatus according to an embodiment.

Referring to FIG. 6, the functions of image forming apparatus 100 will be described. FIG. 6 is a block diagram showing an exemplary functional configuration of image forming apparatus 100.

As shown in FIG. 6, image forming apparatus 100 includes control device 18 and fan 40. Control device 18 includes, as a functional configuration, a measuring unit 110, a fan control unit 112, a count unit 114, a measuring unit 116, and a deactivating unit 118.

Measuring unit 110 calculates the time (that is, the non-operating time) from when image forming apparatus 100 shifts to the non-operating state to when it shifts to the operating state. More specifically, measuring unit 110 stores the time when the operating state shifts to the non-operating state, as history. When image forming apparatus 100 returns from the non-operating state to the operating state, measuring unit 110 calculates the time difference between the present time and the shift time indicated by the history, as the non-operating time. Measuring unit 110 outputs the measured time as the non-operating time to fan control unit 112.

Fan control unit 112 controls the fan based on the non-operating time. More specifically, when the non-operating time is shorter than a predetermined time, fan control unit 112 allows fan 40 to operate in the normal mode. When the non-operating time is a predetermined time or longer, fan control unit 112 allows fan 40 to operate in the suppression mode.

As an example, the fan control with the suppression mode is executed during a warm-up. The warm-up refers to a function for increasing the temperature of fixing device 30 (see FIG. 1) to a temperature that allows a toner image to be fixed on a print material. Image forming apparatus 100 executes a warm-up based on acceptance of a print instruction. When the second printing since power-on of image forming apparatus 100 is done to cause a shift from the non-operating state to the operating state and the temperature of fixing device 30 at the start of the warm-up function is a predetermined temperature or lower, fan control unit 112 allows fan 40 to operate in the suppression mode. The temperature is, for example, detected by thermistors 36A, 36B described later. The temperature may be detected by another temperature sensor installed in image forming apparatus 100.

Count unit 114 counts the number of repetitions of the operating state and the non-operating state of image forming apparatus 100. Count unit 114 clears the number of repetitions, based on power-on of image forming apparatus 100. Count unit 114 outputs the number of repetitions to deactivating unit 118.

Measuring unit 116 measures the elapsed time (hereinafter also referred to as "suppression time") since fan 40 starts operating in the suppression mode. More specifically, measuring unit 116 starts measuring the time based on that fan 40 shifts to the suppression mode, and finishes measuring the time at the point of time when the suppression mode shifts to the normal mode. Measuring unit 116 outputs the measured suppression time to deactivating unit 118.

Deactivating unit 118 determines whether a deactivation condition described above is satisfied. When it is determined that a deactivation condition is satisfied, deactivating unit 118 outputs an instruction to fan control unit 112 to deactivate operation of fan 40 in the suppression mode.

In an aspect, when the number of repetitions counted by count unit 114 is a predetermined number or greater, deactivating unit 118 determines that a deactivation condition is satisfied. In another aspect, when the suppression time measured by measuring unit 116 is a predetermined time or longer, deactivating unit 118 determines that a deactivation condition is satisfied.

[Control Structure of Image Forming Apparatus 100]

Figure 7:
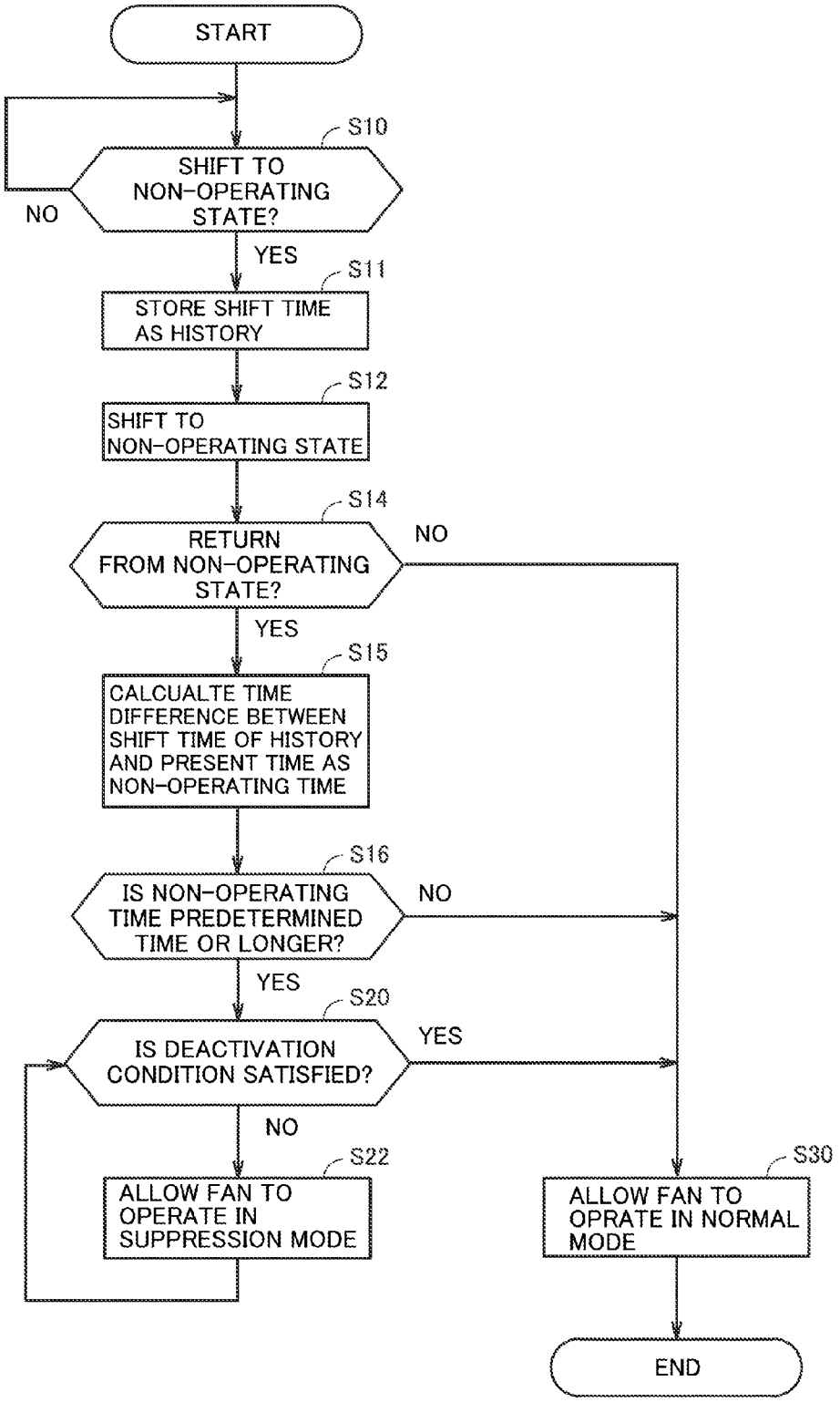
FIG. 7 is a flowchart illustrating part of the processing executed by the image forming apparatus according to an embodiment.

Referring to FIG. 7, the control structure of image forming apparatus 100 will be described. FIG. 7 is a flowchart illustrating part of the processing executed by image forming apparatus 100. The processing in FIG. 7 is implemented, for example, by control device 18 serving as a CPU (Central Processing Unit) executing a program. In another aspect, part or the whole of the processing in FIG. 7 may be performed by circuit elements or other hardware.

In step S10, control device 18 serves as measuring unit 110 (see FIG. 6) to determine whether to shift to the non-operating state. As an example, control device 18 shifts to the non-operating state when a print instruction is not accepted for a predetermined time or longer. When it is determined to shift to the non-operating state (YES in step S10), control device 18 switches the control to step S11. If not (NO in step S10), control device 18 performs the processing in step S10 again.

In step S11, control device 18 serves as measuring unit 110 to store the time of shifting to the non-operating time, as history. The history is stored in, for example, a storage device 120 described later.

In step S12, control device 18 shifts the operating state of image forming apparatus 100 to the non-operating state.

In step S14, control device 18 serves as fan control unit 112 (see FIG. 6) to determine whether image forming apparatus 100 returns from the non-operating state to the operating state. For example, image forming apparatus 100 returns from the non-operating state to the operating state, based on acceptance of a print instruction from another device. When it is determined that image forming apparatus 100 returns from the non-operating state to the operating state (YES in in step S14), control device 18 switches the control to step S15. If not (NO in step S14), control device 18 switches the control to step S30.

In step S15, control device 18 serves as measuring unit 110 to refer to the history stored in storage device 120 to acquire the time of shifting to the non-operating state, and calculates the time difference between the acquired time and the present time, as the non-operating time.

In step S16, control device 18 serves as fan control unit 112 to determine whether the non-operating time is a predetermined time (for example, 30 seconds) or longer. When it is determined that the non-operating time is a predetermined time or longer (YES in step S16), control device 18 switches the control to step S20. If not (NO in step S16), control device 18 switches the control to step S30.

In step S20, control device 18 serves as deactivating unit 118 (see FIG. 6) to determine whether a deactivation condition described above is satisfied. If it is determined that a deactivation condition is satisfied (YES in step S20), control device 18 switches the control to step S30. If not (NO in step S20), control device 18 switches the control to step S22.

In step S22, control device 18 serves as fan control unit 112 to start the operation of fan 40 (see FIG. 1) in the suppression mode. That is, control device 18 allows fan 40 to operate with lower power compared with step S30.

In step S30, control device 18 serves as fan control unit 112 to start the operation of fan 40 in the normal mode. That is, control device 18 increases the rotation time and the rotation speed of fan 40, compared with the fan control in step S22.

[Hardware Configuration of Image Forming Apparatus 100]

Figure 8:
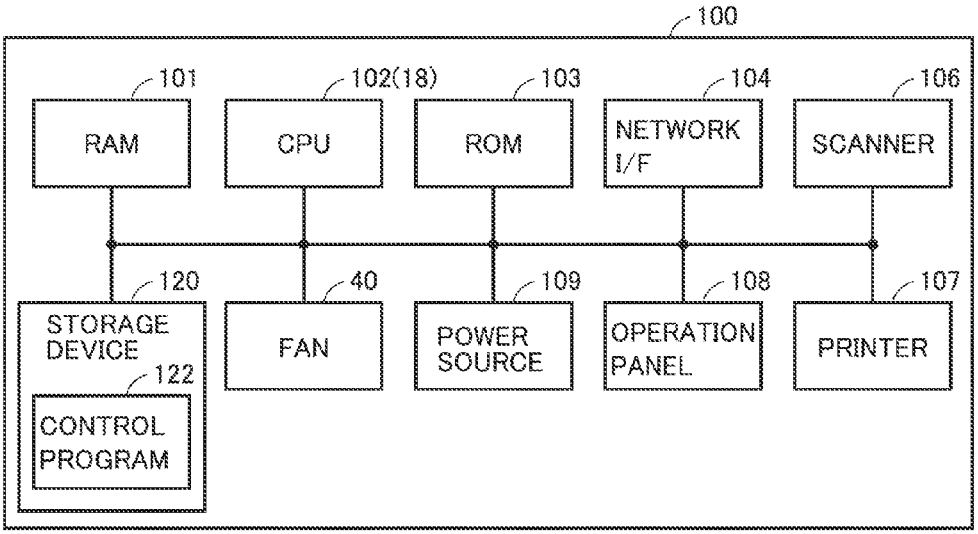
FIG. 8 is a block diagram showing the main hardware configuration of the image forming apparatus according to an embodiment.

Referring to FIG. 8, an exemplary hardware configuration of image forming apparatus 100 will now be described. FIG. 8 is a block diagram showing the main hardware configuration of image forming apparatus 100. As shown in FIG. 8, image forming apparatus 100 includes fan 40, a ROM (Read Only Memory) 101, a CPU 102, a RAM (Random Access Memory) 103, a network I/F (interface) 104, a scanner 106, a printer 107, an operation panel 108, and a storage device 120.

ROM 101 stores, for example, a control program to be executed in image forming apparatus 100. CPU 102 is control device 18 described above. CPU 102 executes a variety of programs such as a control program for image forming apparatus 100 to control the operation of image forming apparatus 100. RAM 103 functions as a working memory to temporarily store a variety of data necessary for executing the control program.

Network I/F 104 is connected with, for example, an antenna (not shown). Image forming apparatus 100 exchanges data with other communication equipment through the antenna. Other communication equipment includes, for example, mobile communication terminals such as smartphones, and servers. Image forming apparatus 100 may be configured to download control program 122 according to the present embodiment from a server through the antenna.

Scanner 106 optically scans an original set on image forming apparatus 100 to generate image data of the original.

Printer 107 converts image data read by scanner 106 or print data transmitted from an external information processing apparatus into data for printing, for example, by electrophotography, and prints an image of a document or other data based on the converted data.

Operation panel 108 is formed as a touch panel to accept touch operation by the user on image forming apparatus 100. As an example, operation panel 108 includes a display panel and a touch sensor superimposed on the display panel.

Power source 109 supplies power to a variety of devices in image forming apparatus 100 based on that the user presses the power button (not shown) of image forming apparatus 100.

Storage device 120 is, for example, a recording medium such as a hard disk or an external storage device. Storage device 120 stores, for example, control program 122 for implementing the processing according to the present embodiment.

Control program 122 according to the present embodiment may not be provided in the form of a single program but may be built in part of any given program. In this case, the processing according to the present embodiment is implemented in cooperation with any given program. Even such a program not including some modules does not depart from the scope of the program according to the present embodiment. Some or all of the functions provided by control program 122 according to the present embodiment may be implemented by dedicated hardware. Image forming apparatus 100 may be configured in the form of cloud service such that at least one server implements the processing according to the present embodiment.

[Fixing Device 30]

(Structure of Fixing Device 30)

Figure 9:
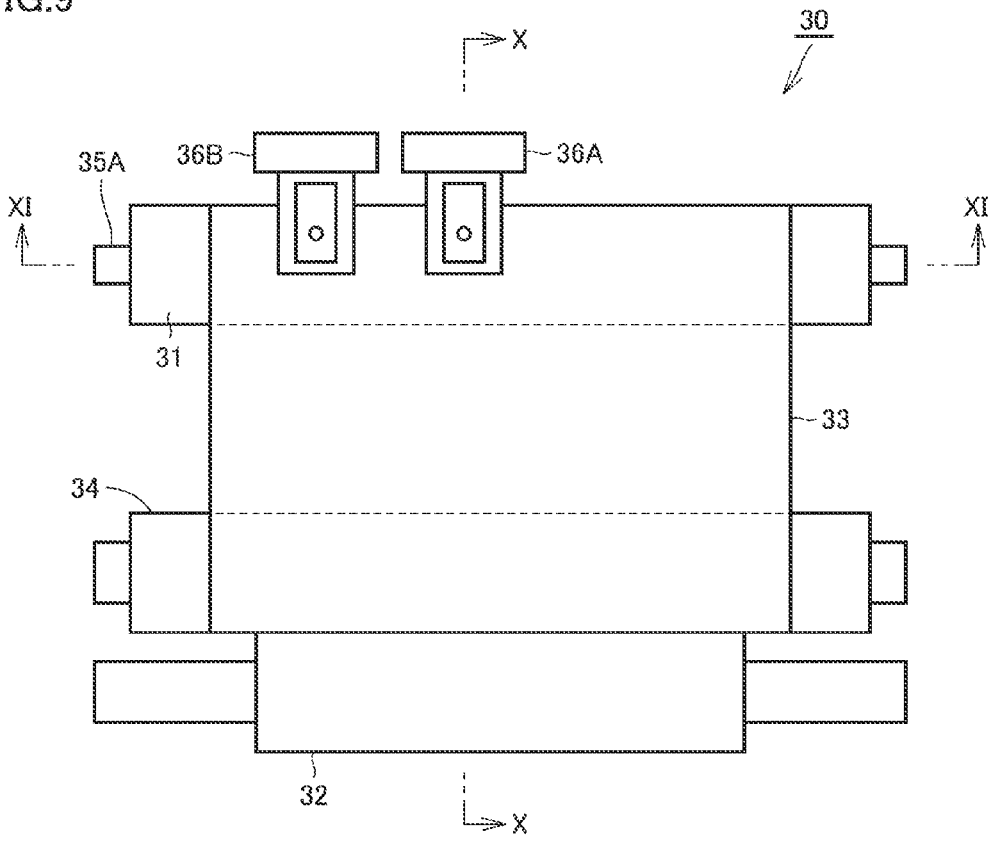
FIG. 9 is a plan view of a fixing device.
Figure 10:
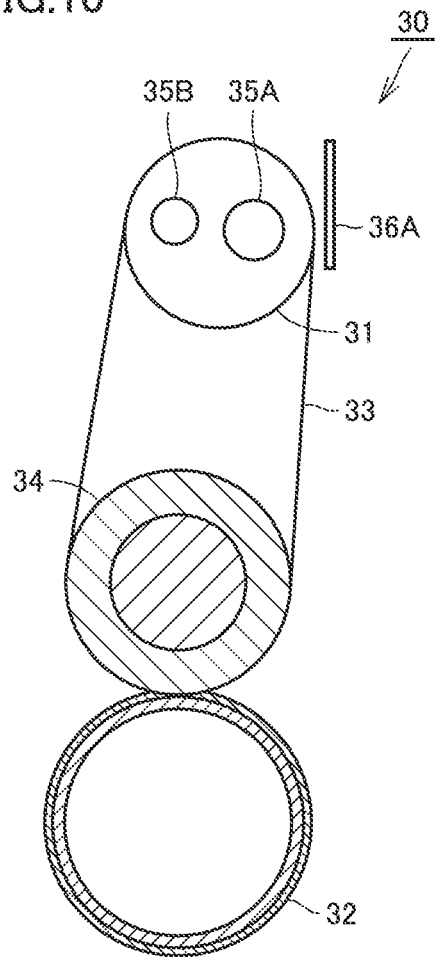
FIG. 10 is a cross-sectional view along the line X-X in FIG. 9.
Figure 11:
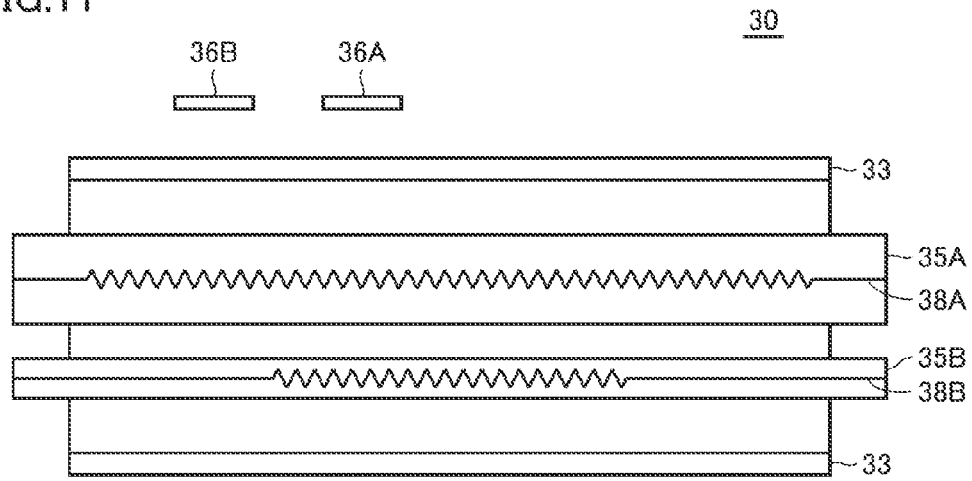
FIG. 11 is a cross-sectional view along the line XI-XI in FIG. 9.

Referring to FIG. 9 to FIG. 11, the structure of fixing device 30 shown in FIG. 1 will be described. FIG. 9 is a plan view of fixing device 30. FIG. 10 is a cross-sectional view along the line X-X in FIG. 9. FIG. 11 is a cross-sectional view along the line XI-XI in FIG. 9.

As shown in FIG. 9 to FIG. 11, fixing device 30 includes a heating roller 31, a pressing roller 32, a fixing belt 33, a fixing roller 34, a long heater 35A, a short heater 35B, and thermistors 36A, 36B.

Heating roller 31 is formed of a cylindrical core made of, for example, aluminum. The thickness of the core is, for example, 0.6 mm. The core has a resin layer, for example, made of PTFE (polytetrafluoroethylene) on its outer circumferential surface. The thickness of PTFE is, for example, about 15 μm. The outer diameter of heating roller 31 is, for example, 25 mm. The longitudinal length of heating roller 31 is, for example, 30 mm.

Pressing roller 32 is formed of a cylindrical core made of, for example, aluminum. The outer diameter of pressing roller 32 is, for example, 35 mm. The thickness of the core is, for example, 2 mm. The core has a rubber layer and a resin layer made of, for example, PFA (perfluoro alkoxyl alkane) on its outer circumferential surface. The thickness of the rubber layer is, for example, 2 mm. The thickness of PFA is, for example, 30 μm.

Fixing belt 33 is formed of, for example, polyimide, a rubber layer, and PFA. The outer diameter of fixing belt 33 is, for example, 60 mm. The thickness of polyimide is, for example, 70 mm. The thickness of the rubber layer is, for example, 200 μm.

Fixing roller 34 is formed of a cylindrical core made of, for example, iron. The outer diameter of fixing roller 34 is, for example, 30 mm. The outer diameter of the core is, for example, 18 mm. The core has a rubber layer and a sponge layer on its outer circumferential surface. The thickness of the rubber layer is, for example, 4 mm. The thickness of the sponge layer is, for example, 2 mm.

Long heater 35A is, for example, a halogen lamp heater. The power rating of long heater 35A is, for example, 999 W (watts). The luminous intensity distribution of long heater 35A is, for example, 80% or more. Long heater 35A has a heat source 38A inside thereof The length of the part of heat source 38A that generates heat is, for example, 290 mm.

Short heater 35B is, for example, a halogen lamp heater. The power rating of short heater 35B is, for example, 790 W. The luminous intensity distribution of short heater 35B is, for example, 80% or more. Short heater 35B has a heat source 38B inside thereof The length of the part of heat source 38B that generates heat is, for example, 180 mm.

Thermistors 36A, 36B are temperature sensors for detecting the surface temperature of fixing belt 33. Thermistors 36A, 36B are disposed to face fixing belt 33 and are disposed not in contact with fixing belt 33. Thermistor 36A is disposed, for example, at a position 70 mm away from the central paper-passage reference of fixing belt 33 in the longitudinal direction. Thermistor 36B is disposed, for example, at a position 135 mm away from the central paper-passage reference of fixing belt 33 in the longitudinal direction.

(Operation of Fixing Device 30)

Referring now to FIG. 9 to FIG. 11, the operation of fixing device 30 will be described.

Equation (1) below is to be satisfied:

$$TA = A \times T \quad (1)$$

where T is the temperature detected by thermistor 36A; A is a correction coefficient for temperature adjustment; and TA is the corrected temperature for temperature adjustment. Corrected temperature TA is adjusted by turning on/off heat sources 38A, 38B.

The operation of setting the surfaces of fixing belt 33 and pressing roller 32 to a printable temperature after image forming apparatus 100 is powered on is referred to as a warm-up, and the time required for a warm-up is referred to as a warm-up time. The warm-up operation is executed, for example, during a power reset, during recovery from a jam, during closing of the cover, or during recovery from the sleep mode.

In a warm-up operation, fixing device 30 drives heating roller 31 to increase the temperature of heating roller 31 up to a printable temperature (hereinafter also referred to as "setting temperature"). The setting temperature is, for example, 155° C. Fixing device 30 controls long heater 35A and short heater 35B with input of corrected temperature TA.

Image forming apparatus 100 transmits driving force to a drive gear (not shown) to rotate pressing roller 32 and drives the rotation of heating roller 31, fixing belt 33, and fixing roller 34. Heat of heating roller 31 is thus transferred to the surfaces of fixing belt 33 and pressing roller 32. The linear velocity of fixing device 30 at this point of time is, for example, 135 mm/s. The heating by heating roller 31 and the rotation of heating roller 31 increase the temperatures of the surfaces of fixing belt 33 and pressing roller 32 to a printable temperature.

When corrected temperature TA obtained by multiplying temperature T detected by thermistor 36A by correction coefficient A reaches a printable temperature, fixing device 30 outputs a signal (ready) indicating that print is ready to image forming apparatus 100. The signal is output, for example, based on that corrected temperature TA reaches 135° C. When a print signal is not accepted, image forming apparatus 100 enters a waiting state. When a print signal is accepted, image forming apparatus 100 starts printing. The setting temperature in the waiting state is, for example, 155° C. to 150° C. The setting temperature is controlled by the turning on/off of long heater 35A and short heater 35B. The setting temperature varies depending on the detected temperature at the start of a warm-up, paper type, color print/monochrome print, and the like.

[Conclusion]

As described above, image forming apparatus 100 allows fan 40 to operate in the normal mode when the time (that is, the non-operating time) from shifting to the non-operating state to shifting to the operating state is shorter than a predetermined time. When the non-operating time is a predetermined time or longer, image forming apparatus 100 allows fan 40 to operate in the suppression mode.

Image forming apparatus 100 thus can suppress unnecessary operation of fan 40. As a result, while the internal temperature of image forming apparatus 100 is kept at a predetermined temperature or lower, noise of fan 40 can be reduced, power consumption of fan 40 can be suppressed, and the service life of fan 40 can be prolonged.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus having an operating state and a non-operating state with power consumption smaller than power consumption in the operating state, comprising:

a fixing device for fixing a toner image on a print material by heat;

a fan for suppressing increase of temperature inside the image forming apparatus by the heat; and a control unit for controlling operation of the fan, wherein the control unit allows the fan to operate with first predetermined power in the operating state, when a time from shifting to the non-operating state to shifting to the operating state is shorter than a first predetermined time, and allows the fan to stop or allows the fan to operate with second predetermined power smaller than the first predetermined power in the operating state, when the time is equal to or longer than the first predetermined time.

2. The image forming apparatus according to claim 1, wherein the control unit deactivates suppression control of the fan by the control unit when the time is equal to or longer than a second predetermined time longer than the first predetermined time.

3. The image forming apparatus according to claim 2, wherein the control unit executes suppression control of the fan by the control unit when the time is equal to or longer than the first predetermined time and the time is shorter than the second predetermined time.

4. The image forming apparatus according to claim 1, further comprising a counter for counting a number of repetitions of the operating state and the non-operating state, wherein the control unit deactivates suppression control of the fan by the control unit when the number of repetitions reaches a predetermined number or greater.

5. The image forming apparatus according to claim 4, wherein the counter clears the number of repetitions, based on power-on of the image forming apparatus.

6. The image forming apparatus according to claim 1, wherein the control unit deactivates suppression control of the fan by the control unit when a suppression time of the fan by the control unit reaches a predetermined time.

7. The image forming apparatus according to claim 1, wherein the fixing device includes a sensor for detecting temperature of the fixing device, the image forming apparatus executes a warm-up function for increasing temperature of the fixing device to a temperature that allows the toner image to be fixed on the print material, based on acceptance of a print instruction, and the control unit executes suppression control of the fan by the control unit when second printing since power-on of the image forming apparatus is executed to cause a shift from the non-operating state to the operating state and the temperature at start of the warm-up function is equal to or lower than a predetermined temperature.

8. The image forming apparatus according to claim 1, wherein the control unit deactivates suppression control of the fan by the control unit when first printing since power-on of the image forming apparatus causes a shift to the operating state and a second print instruction is accepted before shifting from the operating state to the non-operating state.

9. The image forming apparatus according to claim 1, wherein the control unit deactivates suppression control of the fan by the control unit when equipment registered beforehand is connected to the image forming apparatus.

10. The image forming apparatus according to claim 1, wherein the control unit deactivates suppression control of the fan by the control unit when a function registered beforehand is executed.

11. A control method for an image forming apparatus having an operating state and a non-operating state with power consumption smaller than power consumption in the operating state, the image forming apparatus comprising a fixing device for fixing a toner image on a print material by heat, and a fan for suppressing increase of temperature inside the image forming apparatus by the heat, the control method comprising:

allowing the fan to operate with first predetermined power in the operating state when a time from shifting to the non-operating state to shifting to the operating state is shorter than a first predetermined time; and allowing the fan to stop or allowing the fan to operate with second predetermined power smaller than the first predetermined power in the operating state when the time is equal to or longer than the first predetermined time.

12. The control method according to claim 11, further comprising deactivating operation of the fan with the second predetermined power when the time is equal to or longer than a second predetermined time longer than the first predetermined time.

13. The control method according to claim 12, wherein the control method executes operation of the fan with the second predetermined power when the time is equal to or longer than the first predetermined time and the time is shorter than the second predetermined time.

14. The control method according to claim 11, further comprising:

counting a number of repetitions of the operating state and the non-operating state; and deactivating operation of the fan with the second predetermined power when the number of repetitions reaches a predetermined number or greater.

15. The control method according to claim 14, further comprising clearing the number of repetitions, based on power-on of the image forming apparatus.

16. The control method according to claim 11, further comprising deactivating operation of the fan with the second predetermined power when an operation time of the fan with the second predetermined power reaches a predetermined time.

17. The control method according to claim 11, wherein the fixing device includes a sensor for detecting temperature of the fixing device, the image forming apparatus executes a warm-up function for increasing temperature of the fixing device to a temperature that allows the toner image to be fixed on the print material, based on acceptance of a print instruction, and the control method further comprises executing operation of the fan with the second predetermined power when second printing since power-on of the image forming apparatus is executed to cause a shift from the non-operating state to the operating state and the temperature at start of the warm-up function is equal to or lower than a predetermined temperature.

18. The control method according to claim 11, further comprising deactivating operation of the fan with the second predetermined power when first printing since power-on of the image forming apparatus causes a shift to the operating state and a second print instruction is accepted before shifting from the operating state to the non-operating state.

19. The control method according to claim 11, further comprising deactivating operation of the fan with the second predetermined power when equipment registered beforehand is connected to the image forming apparatus.

20. The control method according to claim 11, further comprising deactivating operation of the fan with the second predetermined power when a function registered beforehand is executed.

21. A non-transitory storage medium encoded with a program executed by a computer of an image forming apparatus having an operating state and a non-operating state with power consumption smaller than power consumption in the operating state, the image forming apparatus including a fixing device for fixing a toner image on a print material by heat, and a fan for suppressing increase of temperature inside the image forming apparatus by the heat, the program allowing the computer to execute:

allowing the fan to operate with first predetermined power in the operating state when a time from shifting to the non-operating state to shifting to the operating state is shorter than a first predetermined time; and allowing the fan to stop or allowing the fan to operate with second predetermined power smaller than the first predetermined power in the operating state when the time is equal to or longer than the first predetermined time.

22. The non-transitory storage medium according to claim 21, wherein the program allows the computer to further execute deactivating operation of the fan with the second predetermined power when the time is equal to or longer than a second predetermined time longer than the first predetermined time.

23. The non-transitory storage medium according to claim 22, wherein the program allows the computer to execute operation of the fan with the second predetermined power when the time is equal to or longer than the first predetermined time and the time is shorter than the second predetermined time.

24. The non-transitory storage medium according to claim 21, wherein the program allows the computer to further execute:

counting a number of repetitions of the operating state and the non-operating state; and deactivating operation of the fan with the second predetermined power when the number of repetitions reaches a predetermined number or greater.

25. The non-transitory storage medium according to claim 24, wherein the program allows the computer to further execute clearing the number of repetitions, based on power-on of the image forming apparatus.

26. The non-transitory storage medium according to claim 21, wherein the program allows the computer to further execute deactivating operation of the fan with the second predetermined power when an operation time of the fan with the second predetermined power reaches a predetermined time.

27. The non-transitory storage medium according to claim 21, wherein the fixing device includes a sensor for detecting temperature of the fixing device, the image forming apparatus executes a warm-up function for increasing temperature of the fixing device to a temperature that allows the toner image to be fixed on the print material, based on acceptance of a print instruction, and the program allows the computer to execute operation of the fan with the second predetermined power when second printing since power-on of the image forming apparatus is executed to cause a shift from the non-operating state to the operating state and the temperature at start of the warm-up function is equal to or lower than a predetermined temperature.

28. The non-transitory storage medium according to claim 21, wherein the program allows the computer to further execute deactivating operation of the fan with the second predetermined power when first printing since power-on of the image forming apparatus causes a shift to the operating state and a second print instruction is accepted before shifting from the operating state to the non-operating state.

29. The non-transitory storage medium according to claim 21, wherein the program allows the computer to further execute deactivating operation of the fan with the second predetermined power when equipment registered beforehand is connected to the image forming apparatus.

30. The non-transitory storage medium according to claim 21, wherein the program allows the computer to further execute deactivating operation of the fan with the second predetermined power when a function registered beforehand is executed.

* * * * *